United States Patent [19]

DiMarco et al.

[11] Patent Number: 4,595,896

[45] Date of Patent: Jun. 17, 1986

[54] MOLDED CASE CIRCUIT BREAKER HAVING A REINFORCED HOUSING

[75] Inventors: Bernard DiMarco, Lilburn, Ga.; Charles W. Stanford, Bellefontaine, Ohio

[73] Assignee: Siemens-Allis, Inc., Atlanta, Ga.

[21] Appl. No.: 656,236

[22] Filed: Oct. 1, 1984

[51] Int. Cl.[4] ..... H01H 9/02

[52] U.S. Cl. ..... 335/202; 335/195

[58] Field of Search ..... 335/16, 38, 42, 165, 335/174, 195, 202

[56] References Cited

U.S. PATENT DOCUMENTS

| | | | |
|---|---|---|---|
| 3,602,852 | 8/1971 | Brackett et al. | 335/202 |
| 3,842,376 | 10/1974 | Mune | 335/202 |
| 4,266,209 | 5/1981 | DiMarco et al. | 335/202 X |
| 4,523,164 | 6/1985 | Aoyama et al. | 335/16 X |
| 4,550,300 | 10/1985 | Jencks et al. | 335/16 |

*Primary Examiner*—George Harris

*Attorney, Agent, or Firm*—F. W. Powers; J. L. James

[57] ABSTRACT

A circuit breaker with blow open contacts is provided with a housing. Each pole of the circuit breaker has a reinforced molded housing. The walls of the housing are provided with reinforcing ribs to withstand the high pressures caused by gases generated by the arc during interruption of high short circuit currents.

6 Claims, 13 Drawing Figures

MOLDED CASE CIRCUIT BREAKER HAVING A REINFORCED HOUSING

CROSS-REFERENCE TO RELATED APPLICATIONS

The subject matter described in this applications related to the material disclosed in co-filed patent applications Sn 656,233 "Multi-Pole Molded Case Circuit Breaker With A Common Contact Operating Crossbar Member"—B. DiMarco and C. W. Stanford, Sn 656,230 "Circuit Breaker Contact Arm Assembly Having A Magnetic Carrier"—B. DiMarco and C. W. Stanford, and Sn 656,230 "Magnetic Structure For Calibrating A Circuit Breaker"—J. W. Young.

BACKGROUND OF THE INVENTION

This invention relates generally to molded case circuit breakers of the type which have blow off contacts and more particularly to molded case circuit breakers which house individual poles of a circuit breaker.

Circuit breakers are widely used to open and close circuits to control current flow. One type of current interrupting mechanism known as a blow off mechanism is commonly used to handle massive overcurrent conditions and to instantaneously open during the first milliseconds that a massive overcurrent condition exists. This type of current limiting circuit breaker employs a high speed mechanism to rapidly separate the contacts upon occurrence of a fault condition to draw an arc between the contacts, allowing the voltage drop across the arc to limit the current flow. The electrodynamic force produced by the current flow through the circuit interrupter is used to rapidly drive the contacts apart and force the arc into an arc extinction device. When the blow open contacts open due to a fault, tremendous gas pressure is generated which severely stresses the circuit breaker case. Because the gas pressure is high and the case walls are relatively thin, the case is susceptible to breaking due to the pressure and the stresses. Accordingly, it can be appreciated that it would be highly desirable to provide a case which resists breaking due to stresses caused by the gas pressure during operation.

The molded casings for circuit breakers are typically constructed of a glass polyester or other material. In the past, the circuit breaker molded case or housing has been basically a two-piece molding. The bottom portion was constructed to house the components while the top portion was just a cover. At one time, little attention was paid to the physical size of the circuit breaker and, as a result, the housings and the circuit breaker itself were large and bulky. Of course, these large, bulky constructions had the requisite strength required to withstand the gas pressures generated during severe operation. However, with the modern trend toward miniaturization of components to maximize the space available, circuit breakers have been undergoing a reduction in size. This size reduction for the circuit breakers enables the component into which the molded case circuit breaker is placed to also undergo a size reduction. These size reductions are very important because they save valuable space and reduce overall costs. But, with the reduction in size has come the tendency to use thinner housings which are more susceptible to breaking and failure than their thicker predecessors. Thus, it can be appreciated that it would be highly desirable to provide a compact circuit breaker housing which has the requisite strength to resist breaking and failure during operation.

One way to have a compact circuit breaker arrangement is to use metal to reinforce the plastic housing; in such a construction the internal components of the circuit breaker poles are mounted on or housed in metal which then attaches to the molded case. Naturally, this is more expensive than mounting the parts directly to the molded housing without the use of additional metal. Also, fabricating metal components is more costly than molding housing parts using the modern materials such as glass reinforced polyester. Accordingly, it would be highly desirable to provide a strong molded case circuit breaker which uses a minimum amount of metal for the requisite strength.

In addition to the molded case being easier and cheaper to fabricate than a metal reinforced case, it is more advantageous to mold cases for individual poles rather than to house multiple poles in a single housing. Housing individual poles in their own housing also has the advantage that certain poles may be interchangeable. Accordingly, it can be appreciated that it would be highly desirable to have a molded case housing for a circuit breaker wherein each pole has its own molded case housing.

Accordingly, it is an object of the present invention to provide a molded case circuit breaker which has a reinforced molded case housing.

Another object of the invention is to provide a molded case housing which houses individual poles of a circuit breaker.

Another object of the present invention is to provide a molded case circuit breaker housing which is strong enough to withstand the tremendous gas pressure generated during operation of the circuit breaker.

SUMMARY OF THE INVENTION

Briefly stated, in accordance with one aspect of the invention, the foregoing objects are achieved by providing a molded case circuit breaker which includes a frame, an operating handle mechanism assembly mounted on the frame, a contact arm assembly, and molded housing case portions which have a plurality of longitudinal and transverse reinforcing protrusions defining spaces for the frame and other components. A second molded housing portion also has a plurality of longitudinal and transverse protrusions defining spaces for the frame and other components which is matable with the first housing portion and when so mated defines cavities for housing the frame and other components. The transverse and longitudinal reinforcing protrusions strengthen the housing around components where there are severe forces acting on the case during interruption of high currents.

In another aspect of the invention, each pole of a multi-pole circuit breaker has a molded case. One pole has an operating handle mechanism assembly while the other poles do not but have reinforcing ribs in the area adjacent the operating handle mechanism assembly.

The protrusions and ribs add strength, especially to the outer walls of the case, and prevent failure of the case during operation caused by gas pressure generated when the contacts blow open during interruption of high fault currents.

BRIEF DESCRIPTION OF THE DRAWINGS

While the specification concludes with claims particularly pointing out and distinctly claiming the subject matter which is regarded as the invention, it is believed that the invention will be better understood from the following description of the preferred embodiment taken in conjunction with the accompanying drawings in which:

DESCRIPTION OF A PREFERRED EMBODIMENT

Figure 1:
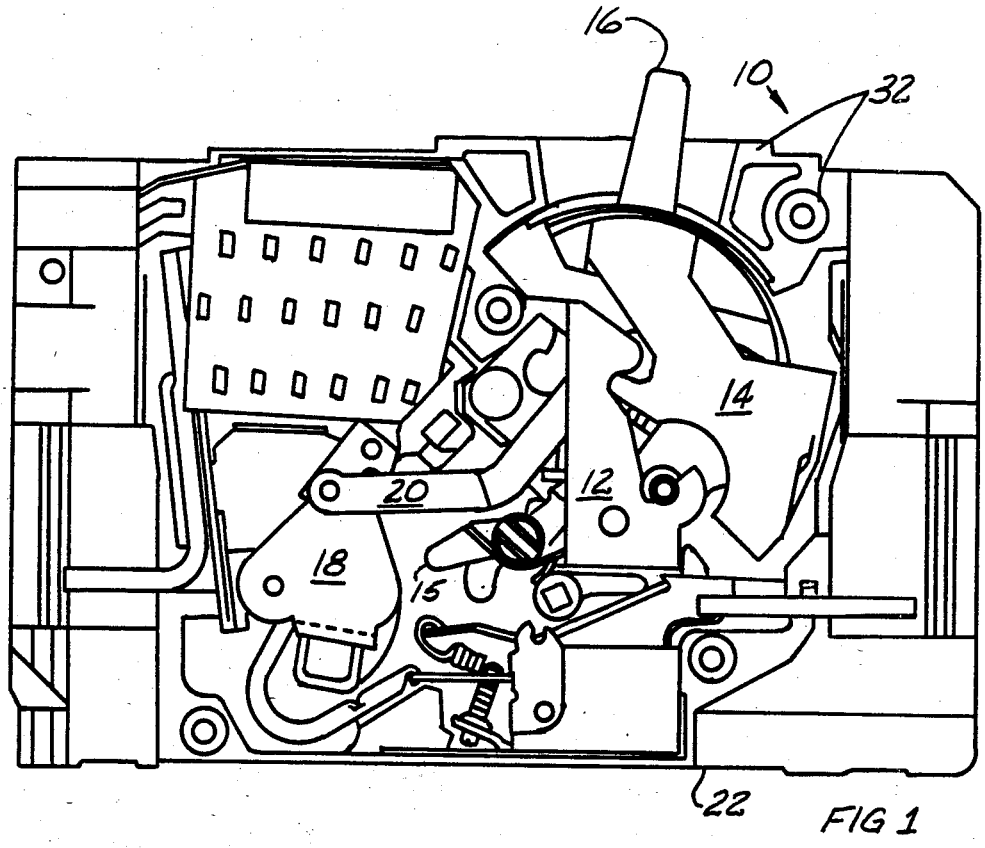
FIG. 1 is one pole of a circuit breaker with the cover removed showing the components mounted on the base.

Referring to FIG. 1, a molded case circuit breaker 10 has a frame 12 with an operating handle mechanism assembly 14 mounted to the frame 12. The operating handle mechanism assembly 14 has an operating handle 16 which is used to manually operate the circuit breaker. This handle 16 is used to open and close the circuit breaker 10 where the breaker consists of a single pole as shown or where the breaker consists of multiple poles as will be discussed hereinbelow. The circuit breaker 10 also has a contact arm assembly 18 and an operating linkage assembly 20 which connects the operating handle mechanism assembly 14 and the contact arm assembly 18 for movement of the contact arm assembly 18 between the open and closed positions. The circuit breaker 10 also has a trip lever 15 which is manually or automatically operated to trip the breaker. In multi-pole arrangements, the trip lever 15 of each pole interlocks with the trip levers of the other poles to provide common tripping.

Figure 2:
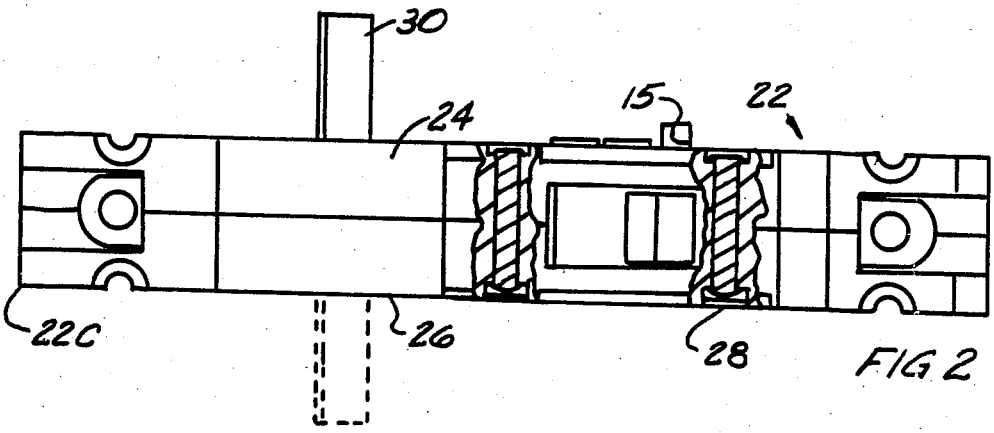
FIG. 2 is a front view of the circuit breaker pole of FIG. 1 with portions cut away to illustrate the fasteners holding the base and cover of the poles together.

Referring to FIG. 2, the circuit breaker 10 has a housing 22 which consists of two parts, a base 24 and a cover 26. The base 24 and cover 26 are individually molded and are preferably composed of a glass polyester material which is well suited for circuit breaker construction. The two parts are made to be matable together and are fastened together using pins or rivets or other fasteners 28. In actual manufacture, a single mold can contain the six housing pieces needed for a three-pole circuit breaker. Thus, in one manufacturing operation, the three poles 22L, C, right (FIG. 5) can be manufactured.

Referring to FIGS. 1, 3, 6, 8 and 11, it is noted that each pole of the circuit breaker 10 has its own contact arm assembly 18. The contact arm assembly has an opening through which a shaft 30 (FIG. 2) extends for operation of the contact arm assembly. The contact arm assembly exerts stress on the case during operation. Since the thickness of the case walls, and thus its strength, is limited in the area where components are placed, there are provided longitudinal and transverse reinforcing ribs or protrusions 32 in the area of the case around the contact arm assembly 18. A plurality of protrusions are also provided in the area of the frame 12 and operating handle mechanism assembly 14. By this construction, when the base 24 and cover 26 of a pole of the circuit breaker are fastened together, pockets are formed which contain the various operating assemblies and mechanisms of the circuit breaker. Thus, the reinforcing protrusions reinforce the case in the areas near the components where the thickness of the case is limited.

In addition, where the left and right poles are used, there is no operating handle mechanism assembly associated with these poles and reinforcing ribs 38 are used in these left and right poles to reinforce the thinner sections of the base 24 and cover 26. The reinforcing ribs 38 may extend either longitudinally or transversely depending upon the particular reinforcing pattern desired. In any event, the reinforcing ribs reinforce what would otherwise be the thinest sections of the housing 22. The openings in the housing for the trip lever 15 may also be reinforced since holes would ordinarily weaken the housing structure. The trip lever 15 has a tongue which protrudes through a housing opening to engage the flush or sliqhtly recessed groove of the trip lever of the adjoining pole.

Figure 10:
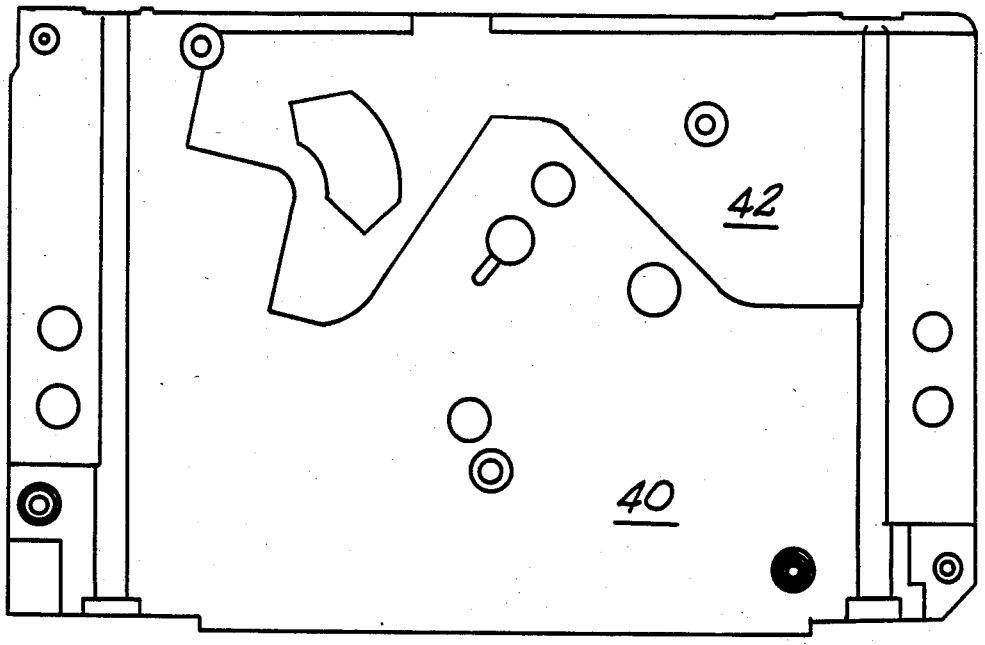
FIG. 10 is a view of the outside of the base shown in FIG. 8 illustrating areas of different thicknesses.
Figure 9:
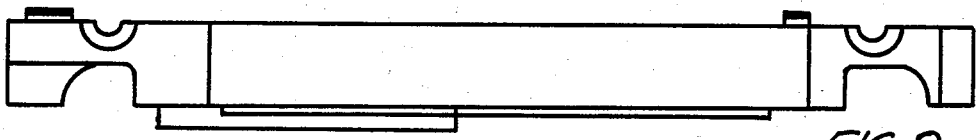
FIG. 9 is a top view of the housing base shown in FIG. 8.
Figure 8:
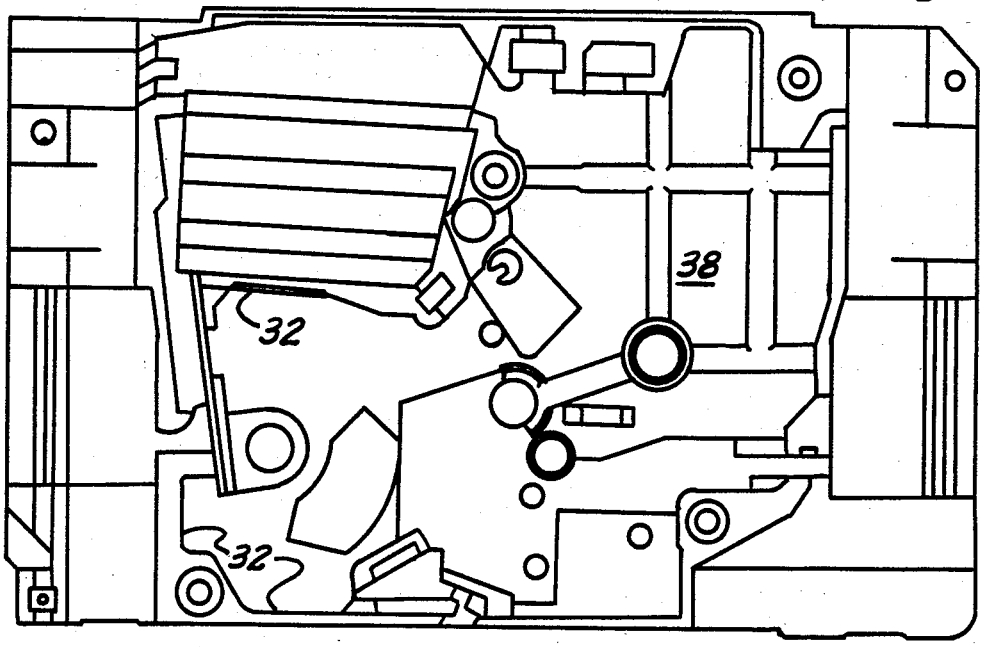
FIG. 8 is a view similar to FIGS. 3 and 6 but showing only the housing with the components mounted thereon removed and showing the reinforcing ribs.
Figure 13:
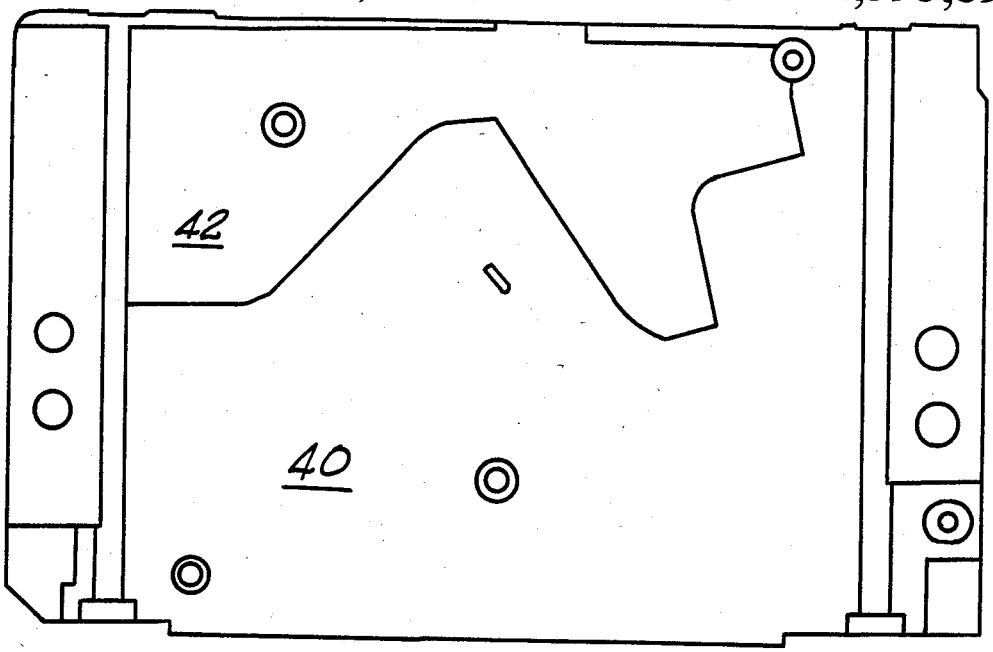
FIG. 13 is a front view of the cover shown in FIG. 11 illustrating areas of different thicknesses.
Figure 12:
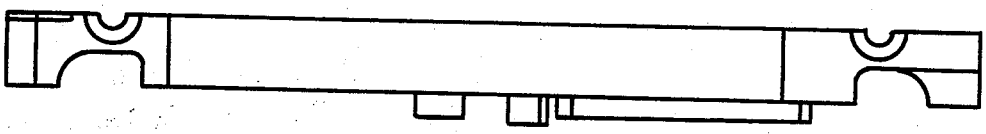
FIG. 12 is a view of the outside of the cover shown in FIG. 11.
Figure 11:
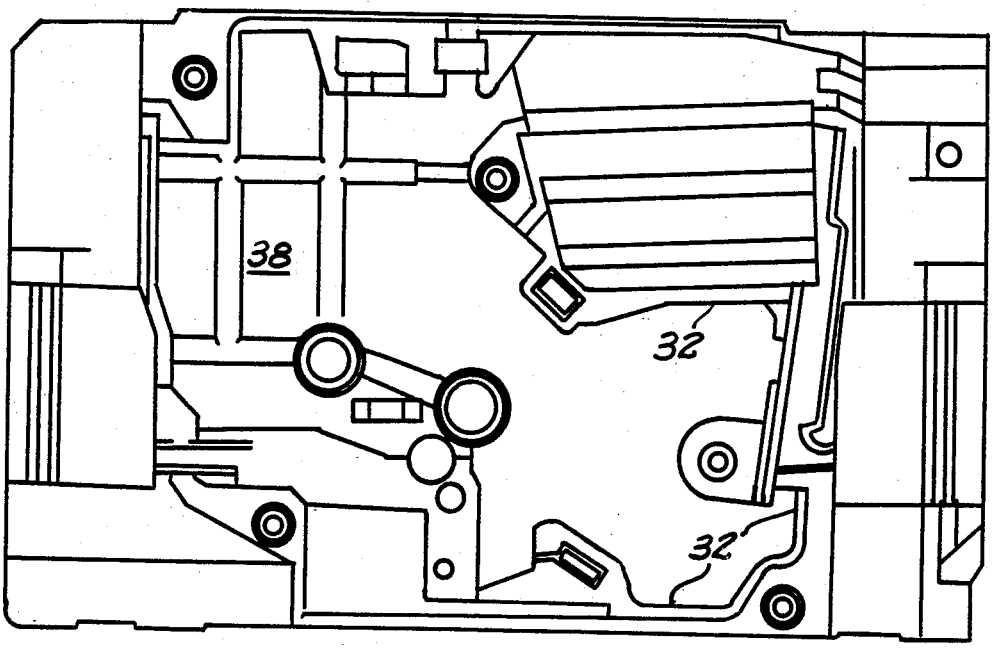
FIG. 11 is a view of the cover for the base shown in FIG. 8.

Referring now to FIGS. 10 and 13, it is seen that the outside of the housing 22 can have varying thicknesses. For example, area 40 has been made thicker than area 42 which provides extra material, thereby increasing the strength, of the portions of the housing which supports the components mounted therein. Since the thickness of the walls is limited by the space available, it is not always possible to provide this extra material, but there is always room for the ribs in multi-pole configurations because the handle mechanism is absent from the outer poles.

Figure 5:
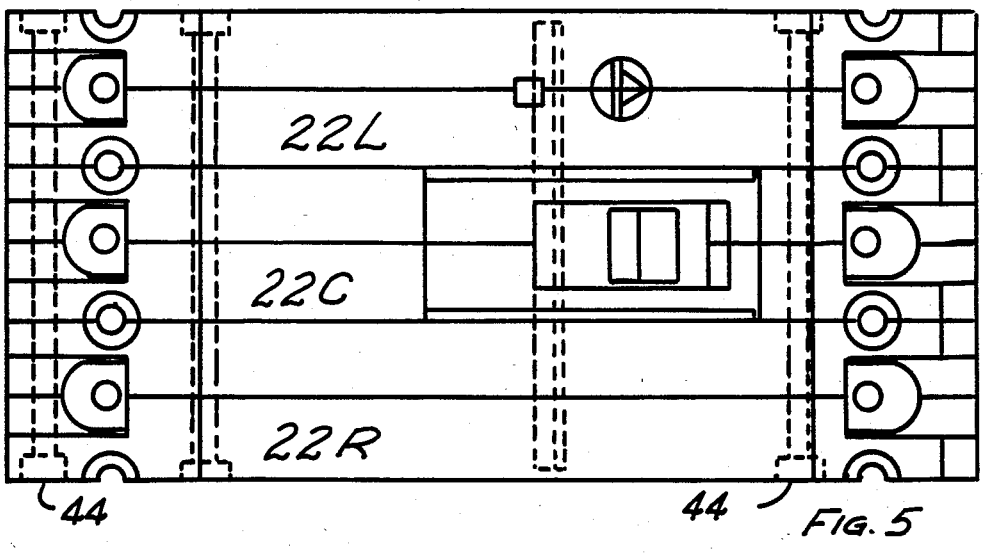
FIG. 5 is a top view similar to FIGS. 2 and 4 but showing a three-pole configuration.
Figure 4:
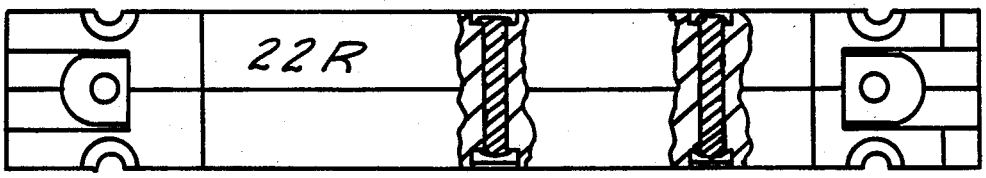
Fig. 4 is a top view similar to FIG. 2 but of the pole shown in FIG. 3.
Figure 3:
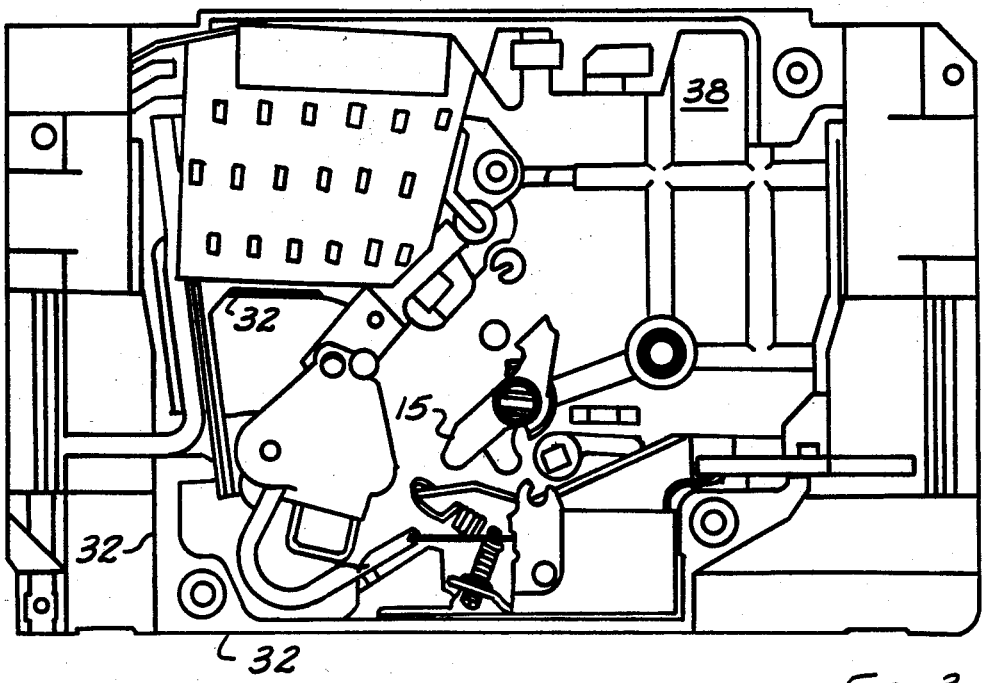
FIG. 3 is a view similar to FIG. 1 showing the right pole of a three-pole circuit breaker.
Figure 7:
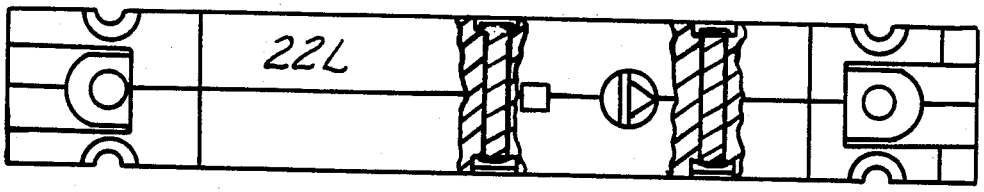
FIG. 7 is a top view similar to FIGS. 2 and 4 but of the pole shown in FIG. 6.
Figure 6:
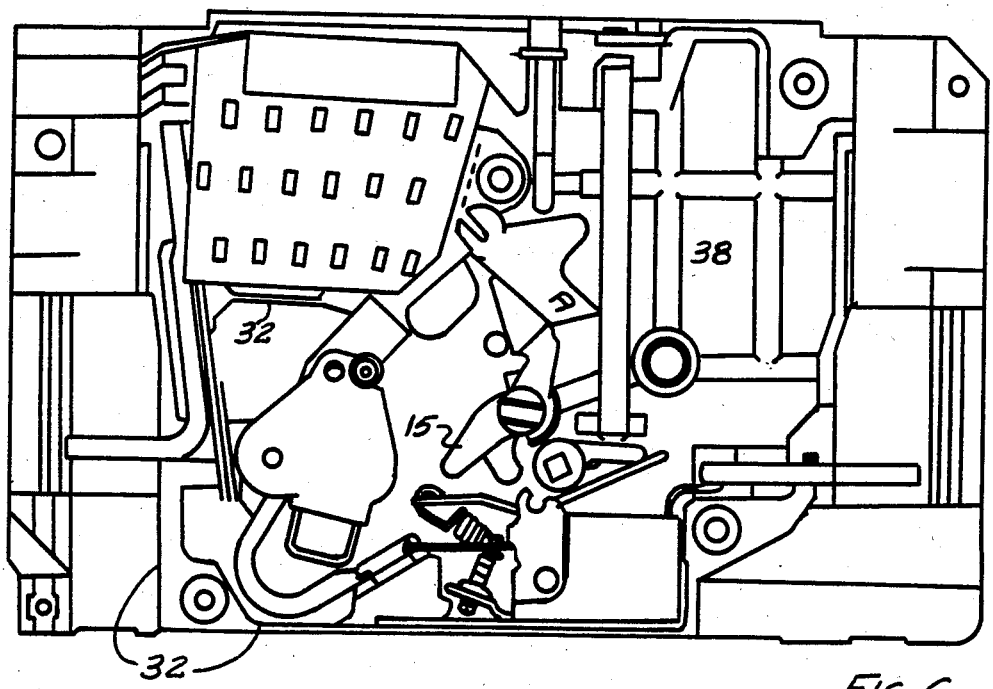
FIG. 6 is a view similar to FIGS. 1 and 3 but showing the configuration for the left pole of multi-pole circuit breaker.

Referring to FIG. 5, the overall strength of the molded case circuit breaker 10 may be increased in the multi-pole version by mechanically fastening the poles together using rivets or other fasteners 44. By mechanically fastening the poles in this fashion, the reinforced pole 22L or 22R can be used to reinforce the central pole 22C which contains the operating handle mechanism assembly.

It will now be understood that there has been disclosed a housing for a molded case circuit breaker which has been reinforced to withstand the gas pressures and stresses encountered during operation particularly during high current interruptions. Transverse and lateral protrusions have been provided in the case walls around components and reinforcing ribs have been added to the thinner sections of the case walls to add strength in the confined space. This is possible because of the molding direction of this design which allows the ribs and protrusions to be added to the mold.

As will be evident from the foregoing description, certain aspects of the invention are not limited to the particular details of the examples illustrated, and it is therefore contemplated that other modifications or applications will occur to those skilled in the art. For example, it is known that during fault conditions when the operating arm operates due to the blow-off effect, heat and gases are generated inside the housing, therefore, exhaust must be provided so that the structural components do not fail. In the present reinforced molded case circuit breaker, openings have been provided so that gases generated during operation can escape to prevent an undesirable build-up. The addition of these holes necessarily weakens the case; however, the holes can be reinforced by adding circular ribs around the holes or by running reinforcing ribs up to the edges of the holes. It will also be noted that the holes for the mounting screws which mount the base to the housing can also be reinforced. The reinforcing is relatively simple since it requires only simple changes to the mold. These mold changes are relatively easy since only one-half of the complete housing is affected at a time. Also, because of the mold direction, the protrusions for pockets for breaker components eliminate the need for rivets, screws and other parts which facilitate assembly. At the same time, the protrusions and reinforcing ribs strengthen the case walls to resist breaking due to gas pressure generated during high current interruption.

Other aspects, objects and advantages of the present invention will become apparent from a study of specification, drawings and appended claims. It is accordingly intended that a claim should cover all such modifications and applications as do not depart from the true spirit and script of the invention.

What is claimed as new and desired to be secured by Letters Patents of the United States is:

1. A molded case circuit breaker, comprising:

a frame;

an operating handle mechanism assembly mounted on the frame;

a contact arm assembly;

an operating link connecting the contact arm assembly and the handle mechanism assembly for movement of the contact arm assembly between an open position and a closed position;

a first molded case housing portion having a plurality of longitudinal and transverse reinforcing protrusions defining spaces for the frame, operating handle mechanism and contact arm assembly;

a second molded case housing portion having a plurality of longitudinal and transverse protrusions defining spaces for the frame, operating handle mechanism and contact arm assembly, said first and second housing portions being matable with one another and entrapping the frame, handle mechanism and contact arm assembly in cavities formed by the longitudinal and transverse protrusions; and a plurality of ribs reinforcing the walls of the housing portions.

2. A molded case circuit breaker, as set forth in claim 1, wherein the frame is fastened to the first housing portion and the first housing portion is reinforced at the location where the frame is attached.

3. A multi-pole molded case circuit breaker, comprising:

a first pole having a frame, an operating handle mechanism assembly mounted on the frame, a contact arm assembly, an operating link connecting the contact arm assembly and the handle mechanism assembly for movement of the contact assembly between an open position and a closed position;

a second pole having a contact arm assembly;

a housing for the first pole having a first molded housing case portion having a plurality of longitudinal and transverse reinforcing protrusions defining spaces for the frame, operating handle mechanism and contact arm assembly and a second molded housing portion having a plurality of longitudinal and transverse protrusions defining spaces for the frame, operating handle mechanism and contact arm assembly, said first and second housing portions being mateable with one another and entrapping the frame, handling mechanism and contact arm assembly in cavaties formed by the longitudinal and transverse protrusions;

a housing for the second pole; and a shaft extending from the contact arm assembly of the first pole through the first and second houses to the contact arm assembly of the second pole for operation of said contact arms in unison between the open and closed positions.

4. A multi-pole molded case circuit breaker, as set forth in claim 3, wherein the housing of the second pole has reinforcing ribs in the walls of the first and second housing portions adjacent the operating handle mechanism assembly of the first pole.

5. A multi-pole molded case circuit breaker, as set forth in claim 3, wherein each pole has a trip lever which interlocks with the trip lever of an adjacent pole.

6. A multi-pole molded case circuit breaker, as set forth in claim 3, wherein the housing of the third pole has reinforcing ribs in the walls of the first and second housing portions adjacent to the operating handle mechanism assembly of the first pole.

* * * * *